United States Patent [19]

Michalak

[11] 4,011,619

[45] Mar. 15, 1977

[54] GOLF BALL WASHER HAVING SCRUB, CLEAN AND DRY ELEMENT

[76] Inventor: Edwin L. Michalak, P.O. Box 253, Tucker, Ga. 30084

[22] Filed: Apr. 1, 1976

[21] Appl. No.: 672,786

[52] U.S. Cl. ..... 15/97 R; 15/21 A

[51] Int. Cl.[2] ..... A63B 47/04

[58] Field of Search ..... 15/3.2, 21 A, 97 R

[56] References Cited

UNITED STATES PATENTS

| | | | |
|---|---|---|---|
| 703,916 | 7/1902 | Haley | 15/3.2 X |
| 2,005,115 | 6/1935 | Stutz | 15/21 A |
| 3,820,183 | 6/1974 | Gustafson et al. | 15/21 A |

*Primary Examiner*—Edward L. Roberts
*Attorney, Agent, or Firm*—Patrick F. Henry

[57] ABSTRACT

A hand-crank operated golf ball washer comprising a cylindrical container in which there is an elongated drive shaft supporting a first scrub element covered in a plastic outdoor carpet material, a second and shorter cleaning element which is covered with the outdoor carpet material, and a third, drying element covered with a towel-like drying material. The ball is directed through helical grooves formed in the outer periphery of the inside of the casing and spaced from the different elements just the correct amount to force the golf ball into contact therewith. Plastic sponge elements are placed within some of the helical grooves and absorbent towel elements are placed in others. The elements are separated by baffles with aligned openings therein to transfer the golf ball.

10 Claims, 4 Drawing Figures

Fig. 1
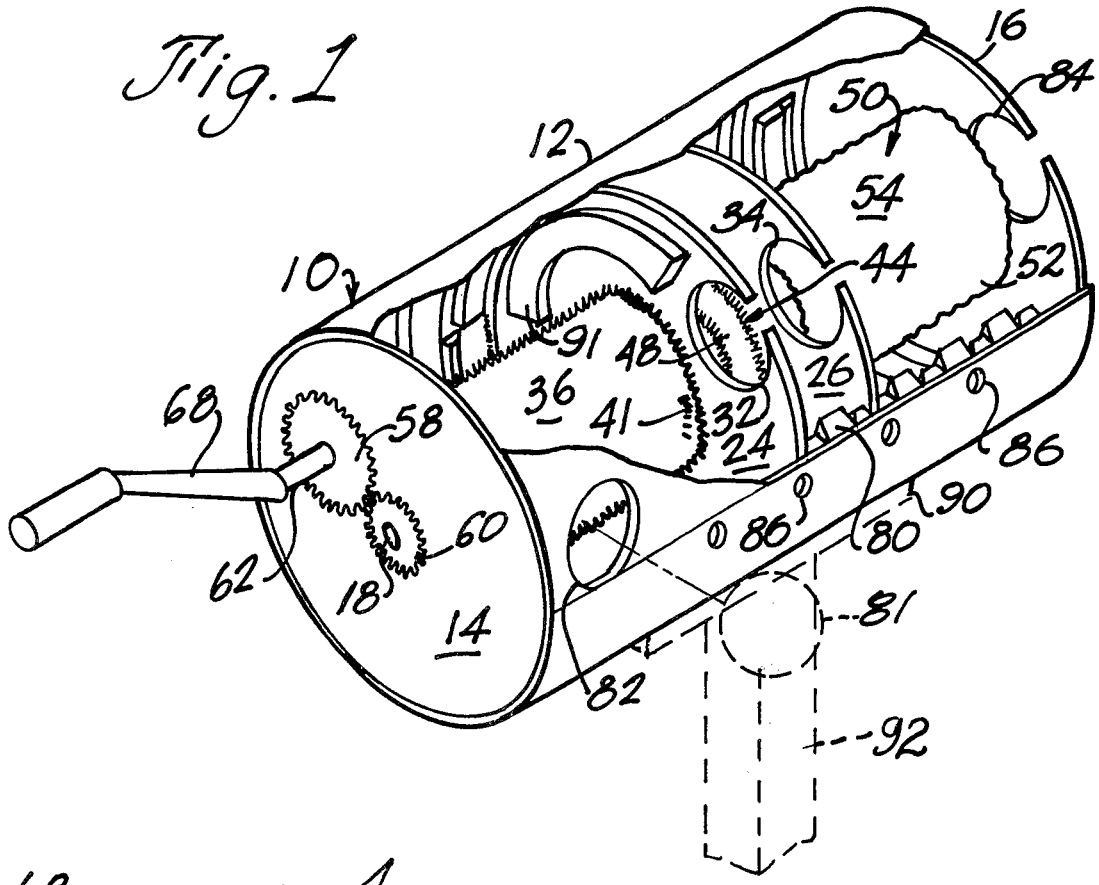
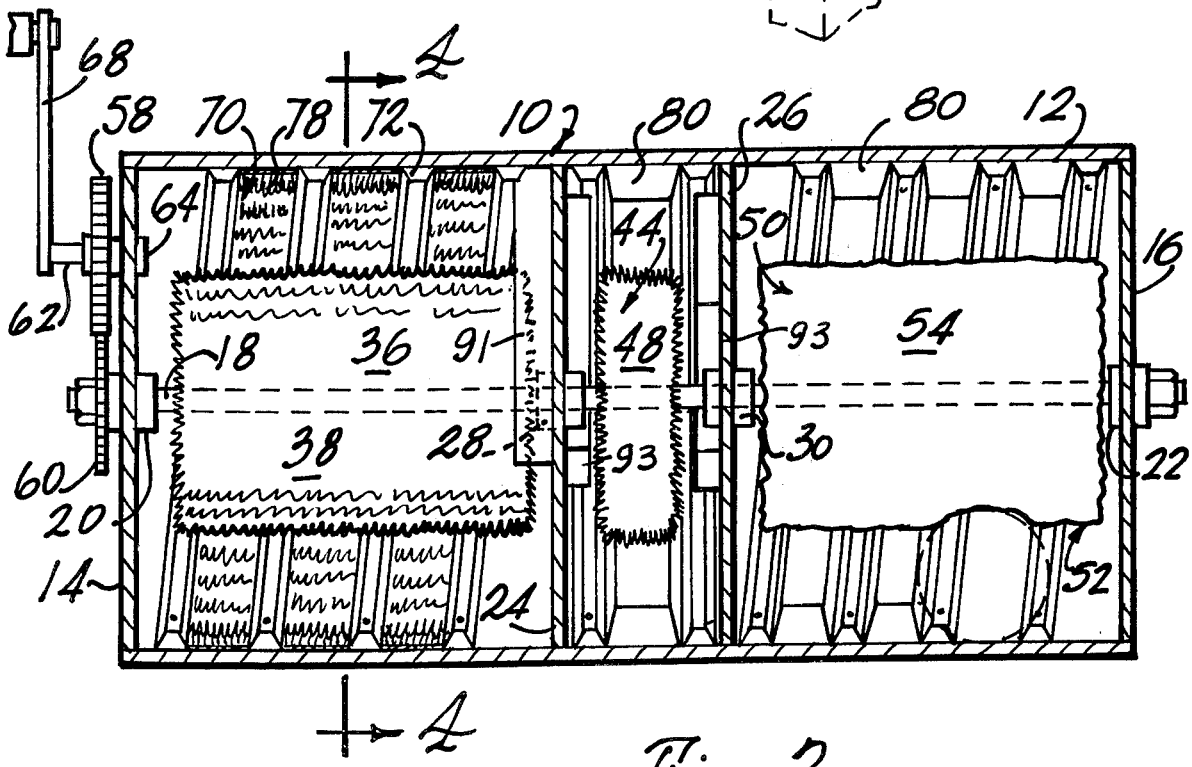
Fig. 2

GOLF BALL WASHER HAVING SCRUB, CLEAN AND DRY ELEMENT

BACKGROUND OF THE INVENTION

1. Field of the Invention

Washing and cleaning machines and devices and especially those with internal means for directing an object such as a golf ball across different cleaning devices.

2. Description of the Prior Art

The prior art discloses a number of golf ball washing machines which direct the ball through a housing in which there is a helical conveyor forcing the balls against a brush scrubbing element. Such devices do not effectively remove the dried stain and material from many golf balls especially those which have been submerged in a lake for a period of time and then allowed to dry prior to cleaning. A conventional bristle brush element simply does not do a complete job. This is true whether the brush element is a cylindrical drum and the helical conveyor is on the outer periphery of the inside of the housing or whether the helical conveyor is located within the center of the housing and the brush element is around the outer periphery of the inside. In addition, some prior art devices utilize electric motors and other drive means which are not suitable for use by golfers on the golf courses and are only suitable for commerical use.

SUMMARY OF THE INVENTION

A golf ball cleaning device comprising a housing or casing in which is mounted a means for cleaning a golf ball which is directed by rotation thereof against a golf ball traveling in a generally helical path around the outside periphery of the inside of the housing and wherein the means for cleaning comprises at least three elements separated by baffles. The first of said elements being covered with a material similar to outdoor synthetic carpet, the second being covered with a pile material similar to the first for picking up loose dirt and the third element being covered with an absorbent pile material similar to toweling.

Also, an additional feature of this invention comprises the device stated in the previous paragraph together with a means such as foam plastic located within the helical grooves through which said golf ball passes to absorb the fluids from the ball.

Another object of this invention is found in the particular arrangement of the cleaning elements and the type of material used for each element together with a baffle means for separating the cleaning procedure into chambers within the housing.

An additional object of this invention is found in the use of a sponge-like material in some of the grooves and an absorbent pile material in other of the grooves for better cleaning and drying of the golf ball.

Other and further object and advantages of this invention will become apparent upon reading the following specification taken in conjunction with the accompanying drawings.

BRIEF DESCRIPTION OF THE DRAWINGS

FIG. 1 is a perspective view of the present device with part of the top of the housing broken away to expose the interior.

FIG. 2 is a longitudinal cross-sectional view taken vertically through the device shown in FIG. 1.

BRIEF DESCRIPTION OF A PREFERRED EMBODIMENT

Figure 3:
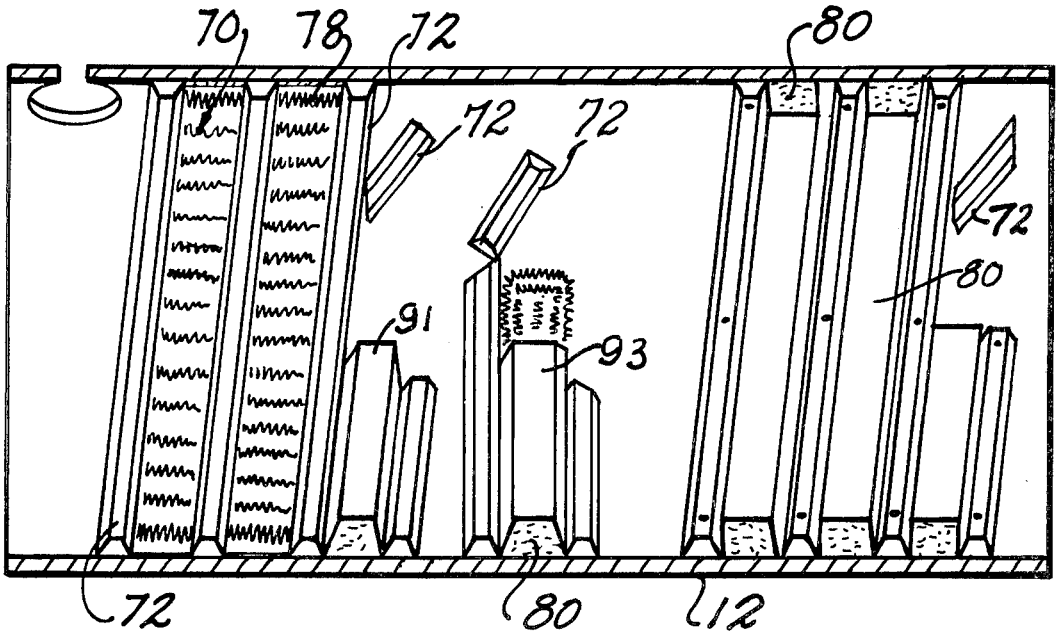
FIG. 3 is a plan view of the top half (half-cylinder) of the cylindrical housing of the device shown in FIG. 1.
Figure 4:
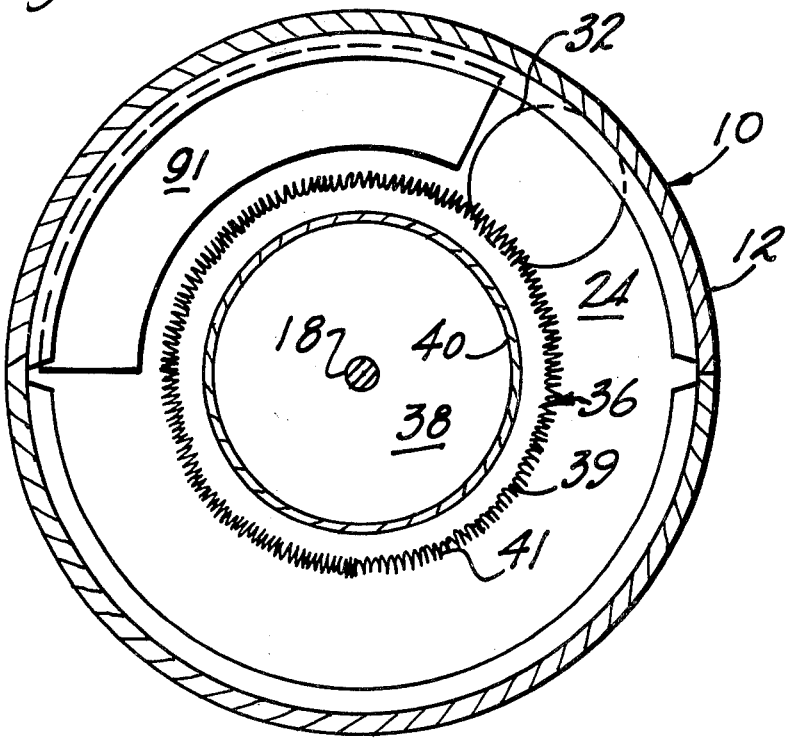
FIG. 4 is a vertical cross-sectional view taken along lines 4—4 in FIG. 2.

The device is designated overall and generally by reference numeral 10 and comprises an outer cylindrical casing or housing 12 which may be manufactured from metal, plastic or other material in a generally cylindrical form made from assembled half-cylinders closed by end plates 14, 16 which may be removed. Supported on and between the respective end plates 14, 16 is a longitudinal shaft 18 mounted in suitable bearings 20, 22 in each respective end plate 14, 16 and also supported on intermediate baffle members 24, 26. Each baffle 24, 26 is a flat circular plate having a respective golf ball opening 32, 34 therein.

The principal cleaning means comprises a first cleaning outdoor carpet material element 36 which comprises a cylindrical roller 38 fastened to the shaft 18 and having a cover surface thereon comprising a tufted material of the sort which is usually called an outdoor carpet such as that used on athletic fields or in other places and including those various brands such as "ASTROTURE" (trademark) or other similar carpet materials. These materials comprise a plurality of plastic strands or members 39 in groups of filaments which project from the outer surface of a backing material 40 and provide small resilient but tough fingers 41 which act against the surface of a golf ball.

An intermediate cleaning element 44 comprises a central roller or core 46 in cylindrical form about which is attached, as by gluing, the same material as element 36 or otherwise fastening a tufted material 48 such as a heavy dense towel material with long tufts.

The third and final cleaning element is designated generally by reference numeral 50 and comprises a center core or roller 52 mounted on shaft 18 and being covered with a very absorbent tufted material such as tufted toweling designated generally by reference numeral 54.

Shaft 18 on the outside of cover plate 14 has a low pitch gear 58 attached thereto which may contain for example 12 teeth and which meshes with the drive gear 60 mounted on a drive shaft 62 which is mounted in a bearing 64 on the end 14. Shaft 62 is attached to a crank having a handle 68. One rotation of the shaft 62 will turn the shaft 18 approximately three times for rapid travel and cleaning of a golf ball.

The inside peripheral face of the housing or casing 12 is provided with a spiral track designated generally by reference numeral 70 and being defined by means of side track members 72 spaced apart approximately the width of a golf ball's diameter. The track 70 terminates at each of the respective openings 32, 34 and resumes on the other side so as to separate the cleaning operation of the ourdoor carpet material element 36 in the first stage from the carpet material absorbent tufted material 48 in the second stage and from the final absorbent cleaning material 54 in the final stage.

The track 70 may be lined with the outdoor carpet material 78 in the first stage between the side 72 and with a plastic foam material 80 in the second stage as well as the subsequent final stage of the cleaning.

The ball 81 is inserted thru an entrance hole 82 leading to the front groove. The golf ball exit hole 84 is next to the end of the final cleaning roller 50 and a plurality of vent holes 86 are provided above the normal solution level when the device 10 is in its normal horizontal position shown in FIG. 1 attached to a platform 90 which is secured to a vertical post 92 set in the ground or attached in place in some other location. The turning of handle and crank 68 drives the ball 81 thru the spiral groove by contact with the material element 36 first and as the ball 81 is squeezed against the material 78. Short sections of foam strip 91, 93 perform and serve as guides for the ball prior to entry into opening 32 in baffle 24 or thru opening 34 in baffle 26. The foam strips 91, 93 resiliently squeeze and guide a ball 81 thru the respective openings 32 or 34.

The pressure between the moving, respective element 36, in response to the movement of the shaft 18 from turning crank and handle 68, and the golf ball 81 in the track 70 causes the ball 81 to move in the spiral track 70 thru the respective elements 36 passing thru each baffle 24, 26 while picking up solution in the bottom which is filled approximately to the ventholes. The separate cleaning and drying removes the dirt and delivers a very clean ball regardless of original condition.

While I have shown and described a particular embodiment of this invention this is by way of illustration only since there are various other versions and various alterations changes, deviations, eliminations, substitutions, revisions and departures which may be made in the embodiment shown and described without departing from the scope of this invention as defined in the appended Claims.

What is claimed:

1. In a golf ball washing device:

an elongated housing for containing a cleaning solution, end closures on said housing, a first cleaning element mounted in said housing and comprising a surface similar to outdoor carpet material having small resilient fingers thereon, a first baffle in said housing defining a first and second compartment therein, at least one other second cleaning element in said second compartment having a pile surface comprising a highly absorbent material such as toweling, means for rotating said first and second cleaning elements, a spiral golf ball track on the inside of said housing and being wide enough to accommodate a golf ball and spaced from said cleaning elements so that a golf ball is forced into contact therewith during travel on said spiral track, said first baffle having a golf ball hole therein and said track terminating at said hole to release said golf ball to said second compartment and second cleaning element.

2. The device in claim 1: a third compartment having a third cleaning element therein, a second baffle having a golf ball hole therein and said track terminating in said second compartment at said second baffle opening to release said golf ball therethrough.

3. The device in claim 1: a material similar to outdoor carpet material within said track in said first compartment, and absorbent cushion foam material in said track in said second compartment.

4. The device in claim 1: resilient cushion guide members in the form of small strips adjacent said baffle to press on said golf ball and assist in guiding same into and thru said baffle opening.

5. The device in claim 1 wherein said housing is cylindrical and said baffle is a circular plate.

6. The device in claim 1 wherein said first and second cleaning elements are cylindrical and the material is attached therearound.

7. In a golf ball washing device:

an elongated housing for containing a supply of cleaning solution, end closures on said housing, a shaft supported on said end closures and extending through said housing, a first cleaning element mounted on said shaft and comprising a surface similar to outdoor carpet material having small resilient fingers thereon, a first baffle in said housing defining a first and second chamber therein, a second cleaning element in said second chamber and comprising a pile surface, a second baffle in said housing defining said second and third chambers, a third cleaning element mounted in said housing and comprising a highly absorbent pile surface such as toweling, a spiral golf ball track on the inside of said housing and being wide enough to accommodate a golf ball and spaced from said cleaning element so as to force said golf ball into contact therewith during travel on said spiral track, drive means for said shaft, said first baffle having a golf ball hole therein and said track terminating at said hole to release said golf ball to said second chamber and second cleaning element, said second baffle having a golf ball hole therein and said track terminating in said second chamber at said second baffle opening to release said golf ball therethrough.

8. The device in claim 7: a material similar to outdoor carpet material within said track in said first chamber, and absorbent cushion foam material in said track in said second and final chambers.

9. The device in claim 7: said track stopping at each baffle, and strips of resilient foam plastic material on said baffles to guide and press said golf ball thru said openings.

10. The device in claim 7: a first gear on said shaft, a handle, a second and drive gear engaged with said first gear and driven by said handle.

* * * * *